US007972128B2

(12) United States Patent
Mugge et al.

(10) Patent No.: US 7,972,128 B2
(45) Date of Patent: Jul. 5, 2011

(54) MOLD AND PROCESS FOR FORMING CONCRETE RETAINING WALL BLOCKS

(75) Inventors: Jimmie L. Mugge, Inver Grove Heights, MN (US); Jay J. Johnson, Star Prairie, WI (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 82 days.

(21) Appl. No.: 12/390,887

(22) Filed: Feb. 23, 2009

(65) Prior Publication Data

US 2010/0213347 A1 Aug. 26, 2010

(51) Int. Cl.
*B28B 11/22* (2006.01)

(52) U.S. Cl. ..... 425/225; 264/333

(58) Field of Classification Search ..... 264/333; 425/225

See application file for complete search history.

(56) References Cited

U.S. PATENT DOCUMENTS

| | | | | |
|---|---|---|---|---|
| 511,098 | A | | 12/1893 | Shultz |
| 813,901 | A | | 2/1906 | Leming et al. |
| 824,235 | A | | 6/1906 | Damon |
| 838,278 | A | | 12/1906 | Schwartz |
| 1,166,312 | A | | 12/1915 | Barten |
| 1,219,127 | A | | 3/1917 | Marshall |
| 1,982,730 | A | | 12/1934 | Erkman |
| 2,038,205 | A | | 4/1936 | Case |
| 2,121,450 | A | | 6/1938 | Sentrop |
| 2,916,793 | A | * | 12/1959 | Ellis et al. ..... 425/3 |
| 2,934,807 | A | | 5/1960 | Donati |
| 3,204,316 | A | | 9/1965 | Jackson |
| 3,545,053 | A | | 12/1970 | Besser |
| 3,940,229 | A | | 2/1976 | Hutton |
| 4,047,690 | A | * | 9/1977 | Winter et al. ..... 249/66.1 |
| 4,171,194 | A | * | 10/1979 | Goretti ..... 425/88 |
| 4,218,206 | A | | 8/1980 | Mullins |
| 4,909,970 | A | | 3/1990 | Pardo |
| 5,297,772 | A | | 3/1994 | Stefanick |
| 5,445,514 | A | | 8/1995 | Heitz |
| 5,542,837 | A | | 8/1996 | Johnston |
| 5,589,124 | A | | 12/1996 | Woolford et al. |
| 5,827,015 | A | | 10/1998 | Woolford et al. |
| 5,879,603 | A | | 3/1999 | Sievert |
| 5,939,104 | A | | 8/1999 | Johnston |
| 6,007,321 | A | | 12/1999 | Meckel et al. |

(Continued)

FOREIGN PATENT DOCUMENTS

DE 25 55 714 A1 6/1977

(Continued)

OTHER PUBLICATIONS

Besser Parts & Equipment Catalog, pp. 5, 18-22.

*Primary Examiner* — Yogendra N Gupta
*Assistant Examiner* — Robert J Grun
(74) *Attorney, Agent, or Firm* — Merchant & Gould P.C.

(57) ABSTRACT

A mold and a process for non-manually cleaning the undercut along the bottom edge of the division plate which with a pallet under the mold defines a lip-forming subcavity results in a dry cast concrete block with an inside lip radius that is controlled to be within certain tolerances. Non-manually cleaning the undercut during the molding process can include spraying a jet of fluid, such as compressed air, at the undercut.

10 Claims, 13 Drawing Sheets

U.S. PATENT DOCUMENTS

| | | | | |
|---|---|---|---|---|
| 6,224,815 | B1 | 5/2001 | LaCroix et al. | |
| 6,814,906 | B2 * | 11/2004 | Bergeron et al. | 264/39 |
| 7,208,112 | B2 * | 4/2007 | Scherer | 264/219 |
| 2001/0007380 | A1 | 7/2001 | LaCroix et al. | |
| 2003/0126821 | A1 | 7/2003 | Scherer | |
| 2003/0182011 | A1 | 9/2003 | Scherer | |
| 2004/0004310 | A1 | 1/2004 | LaCroix et al. | |
| 2004/0104511 | A1 | 6/2004 | Griffith | |
| 2006/0273492 | A1 | 12/2006 | Johnson | |
| 2007/0028548 | A1 | 2/2007 | Johnson et al. | |

FOREIGN PATENT DOCUMENTS

| | | | |
|---|---|---|---|
| DE | 100 02 390 | A1 | 7/2001 |
| GB | 2 232 114 | A | 12/1990 |
| WO | WO 03/060251 | A1 | 7/2003 |

* cited by examiner

MOLD AND PROCESS FOR FORMING CONCRETE RETAINING WALL BLOCKS

TECHNICAL FIELD

This disclosure relates generally to the manufacture of concrete blocks. More specifically, this disclosure relates to a mold and process for making concrete retaining wall blocks including a system for automatically cleaning portions of the mold.

BACKGROUND

Modern, high speed, automated concrete block plants and concrete paver plants make use of concrete block molds that are open at the top and bottom. These molds are mounted in machines that cyclically station a pallet below the mold to close the bottom of the mold, deliver dry cast concrete into the mold through the open top of the mold and densify and compact the concrete by a combination of vibration and pressure, and then strip the uncured blocks from the mold by relative vertical movement between the mold and the pallet. For efficient high-volume production, concrete block molds are typically configured to produce multiple blocks simultaneously. A concrete block mold generally comprises two side walls and two end walls (outside division plates) that define the periphery of a mold cavity. Within this mold cavity, inside division plates may be used to sub-divide the mold cavity into a plurality of block-forming cavities. The division plates, whether inside or outside, are generally rectangular-shaped plates attached to the side walls of the mold. Further, the side walls of the block cavity and the division plates may be covered with replaceable mold face linings to protect the mold components from abrasive wear.

As disclosed in U.S. Pat. No. 7,208,112, the complete disclosure of which is incorporated by reference herein, some blocks are formed with patterned, decorative, three-dimensional front faces while retaining the high-speed, mass production of the blocks. As disclosed in U.S. Pat. No. 7,208,112, the blocks can be formed front-face up in the mold, allowing the front face of the block to be contacted by a stripper shoe that imparts a desired three-dimensional pattern to the front face. When a block is formed front-face up in the mold, most of the top and bottom surfaces of the blocks (from the perspective of the block as laid in a wall) are formed by division plates. The side surfaces of the block preferably converge to allow the blocks to be laid up in a curved or radiused wall, making the front of the block wider than the rear of the block. For such a block formed front-face up to be discharged through the bottom of the mold, the side surfaces of a block must be formed by moveable side walls that, in a first position during molding, form the wider front portion and narrower bottom portion of the block, and in a second position during discharge of the block from the mold, moves sufficiently out of the way for the wider front portion of the block to pass through the bottom of the mold.

Some blocks are made to include a flange or lip that extends below the bottom of the block. The lip is designed to abut against the rear face of a like block in the course below that particular block to provide a predetermined set-back from the course below and provide course-to-course shear strength. To manufacture the block in a high speed concrete block mold process, the inside division plates and typically one of the outside division plates have an undercut or instep portion along the bottom edge. The undercut portion, in combination with the pallet that is introduced under the mold to temporarily close the open mold bottom during processing, defines a lip-forming subcavity. The lip-forming subcavity has a shape that results in the formation of the lip on the block. If the lips are not completely formed, there can be resulting problems. Such resulting problems may include a jagged edge at the interface between the lip and the bottom face of the block. This results in a wider inside lip radius. A wider inside lip radius may cause an upper block laid up on a lower block to ride forward, thus creating a forward pitch to the wall system. This can lead to an unstable wall.

Thus, there is a need for a mold and process that provide for an improved block, in which the inside lip radius is controlled.

SUMMARY OF THE DISCLOSURE

In one aspect, a mold for forming dry cast concrete retaining wall blocks front molded face up is provided. The mold includes a pair of opposed mold sidewalls, at least a pair of division plates, and a cleaning system. The mold sidewalls and division plates define a mold cavity having an open top and an open bottom. At least one division plate has a first planar side, a bottom edge, and an undercut along the bottom edge which with a flat pallet under the mold defines a lip-forming subcavity therebetween. The cleaning system is constructed and arranged to non-manually remove dry cast concrete from the undercut.

In one example, the cleaning system includes a fluid injection system to deliver fluid to the undercut. In one example, the fluid is compressed gas, preferably compressed air. In other examples, the fluid can be oil. In other examples, the fluid can be an oil mist and air mixture.

In one embodiment, a control system is provided to direct the operation of the cleaning system. The control system is constructed and arranged to monitor the position of the mold and to emit a jet of compressed gas at the undercut based on the position of the mold.

In another aspect, a process for manufacturing concrete retaining wall blocks is provided. The retaining wall blocks have a bottom face with a lip projecting therefrom. The process includes molding a retaining wall block by depositing a dry cast concrete mixture into a mold, the mold being positioned upright and having two parallel mold sidewalls and at least a pair of division plates defining a mold cavity having an open top and an open bottom. The upright mold is positioned on a pallet so that the open bottom is closed by the pallet. At least one division plate has at least one planar side and a bottom edge with an undercut, which with the pallet, defines a lip-forming subcavity therebetween. Next, there is a step of forming the concrete retaining wall block by compacting the dry cast concrete mixture against surfaces within the cavity, including forming the lip by compacting the dry cast concrete against surfaces in the lip-forming subcavity. Next, the concrete retaining wall block is stripped from the open bottom of the mold and onto the pallet. Then, the undercut is non-manually cleaned.

In one example, the step of non-manually cleaning the undercut includes emitting a jet of compressed gas at the undercut.

In one example, the step of stripping includes moving a moveable sidewall within a block-forming cavity, and the step of non-manually cleaning includes sensing the position of the mold. Based on the position of the mold, a jet of compressed gas is automatically emitted at the undercut.

In one example, there is a step of forming a front face of the concrete retaining wall block by compacting the dry cast concrete mixture with a stripper shoe in the open top of the mold to impart a predetermined three-dimensional pattern to the concrete retaining wall block front face. The predetermined three-dimensional pattern has a relief of at least 0.5 inch.

In another aspect, a division plate for use in a concrete retaining wall block is provided. The division plate includes a planar first side; a planar second side opposite of the planar first side; a first side edge extending between the planar first side and planar second side; a second side edge extending between the planar first side and planar second side; a top side extending between the first side edge and second side edge; and a bottom side extending between the first side edge and second side edge. A bottom edge is at an intersection of the planar first side and the bottom side. The bottom edge has an undercut, the undercut being spaced from at least the first side edge by a first bottom edge section. The undercut is spaced from at least the first side edge by a first bottom edge section. The division plate has a first hole or bore extending from the first side edge, through the first bottom edge section and to the undercut to define a first fluid passageway through the division plate from the first side edge to the undercut.

In one example, the undercut is spaced from the second side edge by a second bottom edge section. The division plate has a second hole or bore extending from the second side edge, through the second bottom edge section, and to the undercut to define a second fluid passageway through the division plate from the second side edge to the subcavity. The first and second fluid passageways oppose each other at opposite ends of the undercut.

DETAILED DESCRIPTION

This disclosure provides a mold and a process for non-manually cleaning a lip forming undercut of a division plate. This process results in a concrete block with an inside lip radius that is controlled to be within certain tolerances. The lip cleaning system will remove dry cast concrete from the undercuts of the division plates which could cause the incomplete lip formation that has been a problem. In the past, the undercuts have been manually cleaned, periodically, within the production environment which added to overall costs. The solution will automatically clean the undercut as part of the molding process.

A. Example Block Construction, FIGS. 1-4

Figure 2:
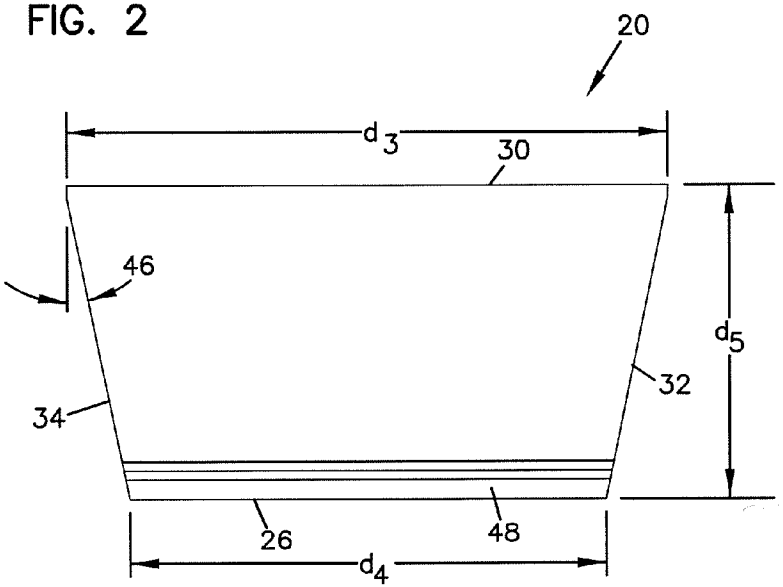
FIG. 2 is a bottom plan view of the retaining wall block of FIG. 1.
Figure 1:
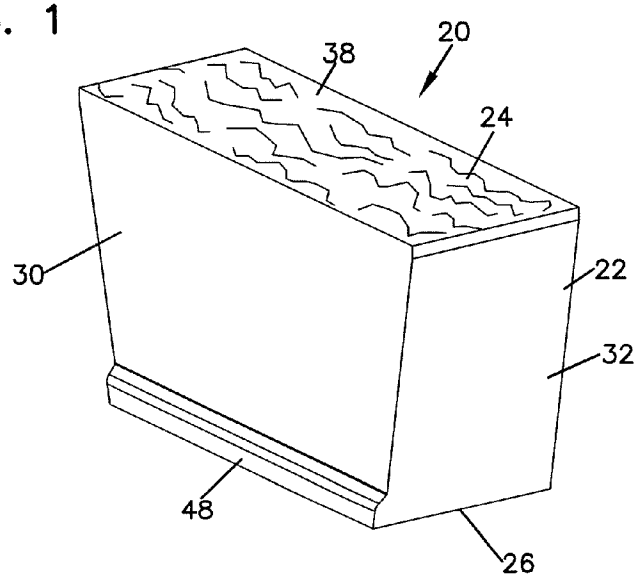
FIG. 1 is a perspective view of a retaining wall block constructed in accordance with principles of this disclosure, the block being oriented in the position in which it is formed in the mold.

A concrete block 20 manufactured with a mold and process according to principles of this disclosure is illustrated in FIGS. 1 and 2 at reference numeral 20. The block 20 includes a block body 22 having a front face 24, a rear face 26, which is opposite of the front face 24, an upper (or top) face 28, a lower (or bottom) face 30, which is opposite of the upper or top face 28, and opposed side faces 32, 34. The terms front, rear, top or upper, and bottom or lower faces reference the orientation of the faces of the block 20 as placed within a retaining wall 36 (FIG. 5) and do not reflect the orientation of the block 20, as it is produced in the mold.

Figure 18:
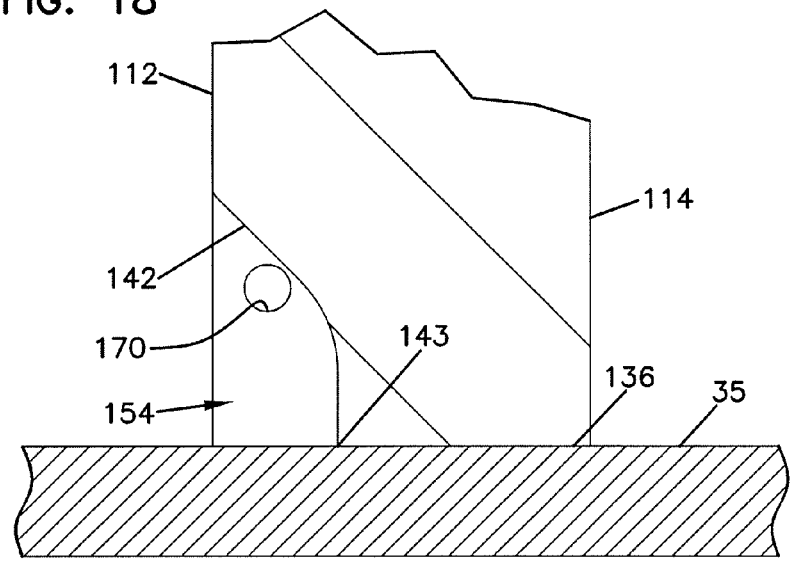
FIG. 18 is the view of FIG. 13*a* and showing a division plate resting on a pallet.

FIG. 1 illustrates the position of the block 20 as it is produced in the mold, with the front face 24 being the uppermost face, and the rear face 26 being the portion of the block 20 that is lowermost and rests on a pallet 35 (FIG. 18) as the block 20 is molded. This process will be discussed further below.

The block 20 is formed from dry cast, no slump concrete. Dry cast, no slump concrete is well-known in the art of retaining wall blocks.

Figure 5:
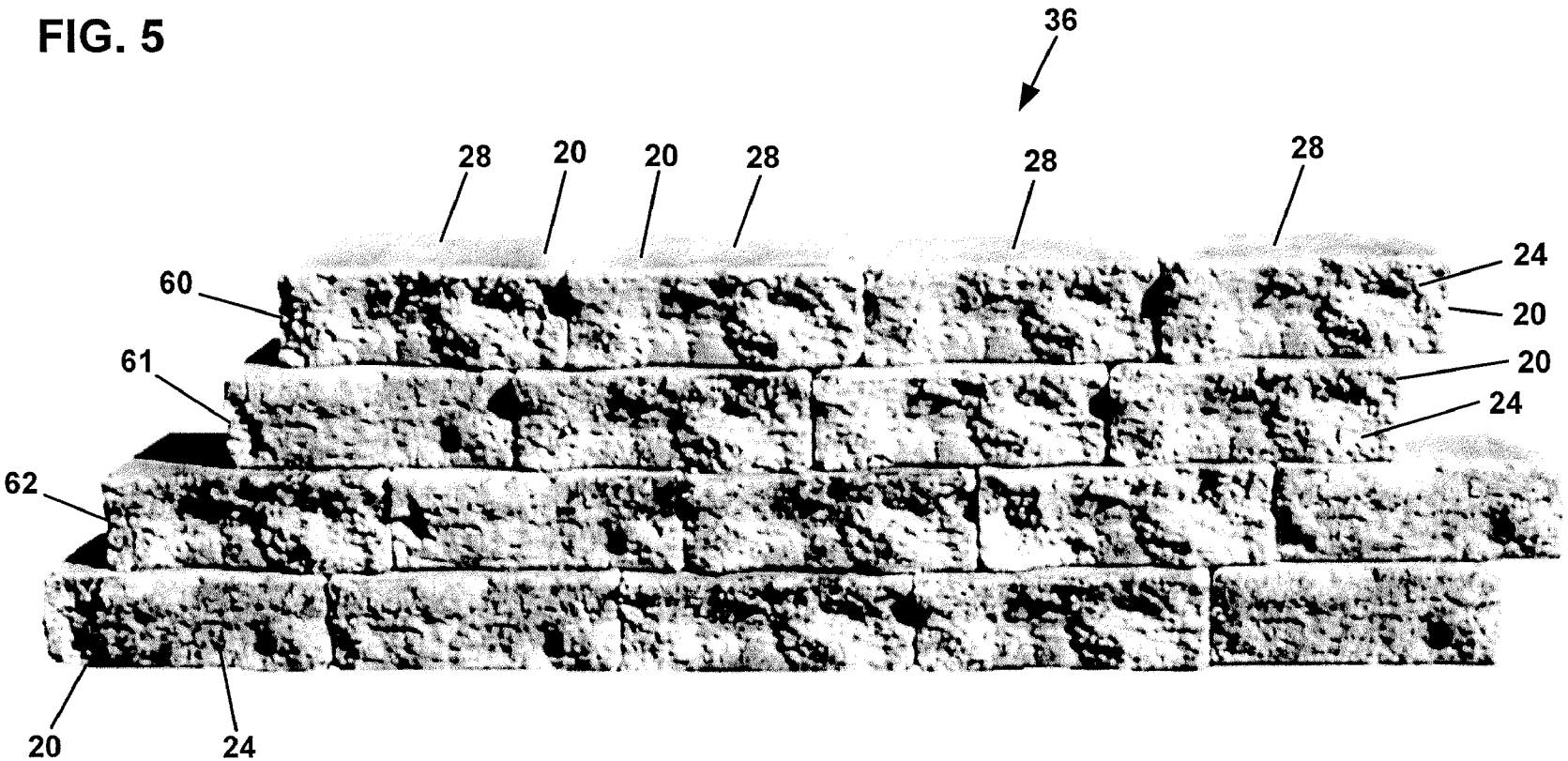
FIG. 5 is a front view of a portion of a retaining wall constructed from a plurality of blocks according to principles of this disclosure.

The front face 24, as shown in FIG. 1 and FIG. 5, can be provided with a predetermined, three-dimensional pattern 38. The pattern 38 on the front face 24 is imparted to the front face 24 during molding of the block 20 by the action of a moveable stripper shoe having a pattern that is the mirror image of the front face 24 of the block 20. Usable stripper shoes and a process for making the stripper shoe is described in U.S. Pat. No. 7,208,112.

The pattern 38 that is imparted to the front face 24 can vary depending upon the desired appearance of the front face 24. In some examples, the pattern 38 simulates natural stone so that the front face 24 appears to be a natural material, rather than a man-made material. The pattern 38 selected can be decorative, distinctive, eye-catching, and visually-pleasing to the intended users of the blocks 20.

The pattern 38 will typically be a three-dimensional pattern, in many example embodiments. By the term "three-dimensional," it is meant a surface pattern that is non-planar with enough variation in the dimensions such that the relief (the distance between the highest and lowest point) in the pattern 38 is at least 0.5 inch, typically between about 0.5 inch and 1.5 inch.

Figure 3:
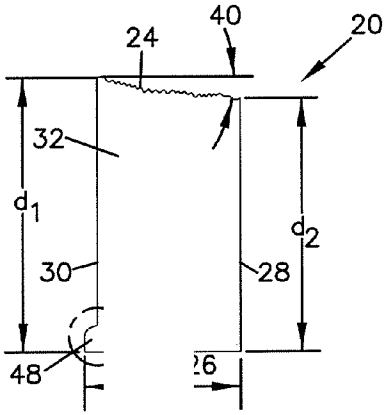
FIG. 3 is a partial side elevational view of the retaining wall block of FIG. 1.

In the embodiment depicted in FIGS. 1 and 2, the front face 24 extends between the side faces 32, 34. In FIG. 3, the front face 24 is provided with a rearward slant, i.e. inclined at an angle 40 from the bottom lower face 30 to the top upper face 28. In other embodiments, the front face does not slant at all. In many embodiments, the angle 40 is at least 5 degrees, typically about 10 degrees. As a result, the front and rear faces 24, 26 are separated by a distance d1 adjacent the lower face 30 and by a distance d2 adjacent the upper face 28, with d1 being larger than d2. In one embodiment, d1 is at least 7.5 inches, and d2 is at least 6.75 inches. In one embodiment, the width d3 is typically at least 11.5 inches.

Typically, when blocks 20 are stacked into set-back courses to form a wall, such as wall 36 of FIG. 5, a portion of the upper face 28 of each block 30 in the lower course is visible between the front face 24 of each block 20 in the lower course and the front face 24 of each block 20 in each adjacent upper course. The visible portions of the upper faces 28 create the appearance of a ledge. In the case of dry cast concrete blocks, this ledge can have an artificial appearance. By providing the rearward incline angle 40 to the front face 24 of the block 20, the appearance of the ledge can be reduced or eliminated, thus enhancing the natural appearance of the resulting wall 36.

Although not depicted in the embodiment shown in FIGS. 1-4, if desired, the front face 24 may include radiused edges at its junctures with the side faces 32, 34. If desired, the top and bottom edges at the junctures between the front face 24 and the upper and lower faces 28, 30 could be radiused.

In FIGS. 2 and 3, in this embodiment, the rear face 26 is illustrated as being generally planar between the side faces 32, 34 and generally perpendicular to the upper and lower faces 28, 30. It is contemplated that, in other embodiments, the rear face 26 could deviate from planar, such as by being provided with one or more notches or provided with one or more concavities, while still being within the scope of this invention. The width d4 (FIG. 2) of the rear face 26 is typically at least 8 inches, for example about 8.2 inches.

The upper face 28 illustrated in FIGS. 3 and 5, is generally planar and is free of cores (or core-free) intersecting the upper face 28. When the blocks 20 are stacked into courses to form the wall, such as wall 36 in FIG. 5, the upper face 28 of each block 20 is in a generally parallel relationship to the upper faces 28 of the other blocks 28 in the wall.

The lower face 30 of the block 20 is formed so as to be suitable for engaging the upper face 28 of the block 20 or blocks 20 in the course below to maintain the generally parallel relationship between the upper face 28 of the blocks 20 when the blocks 20 are stacked into courses. In the embodiment illustrated, the lower face 30 is generally parallel and horizontal so that it is generally parallel to the upper face 28. In other embodiments, the lower face 30 can be non-planar, including one or more concave portions or one or more channels over portions of the lower face 30. The distance d6 between the upper face 28 and the lower face 30 is typically at least 3.75 inches, for example, about 4.0 inches.

In the embodiment illustrated, the side faces 32, 34 are generally vertical and join the upper and lower faces 28, 30 and join the front and rear faces 24, 26, as seen in FIGS. 1-3. At least a portion of each side face 32, 34 converges toward the opposite side faces, as the side faces 32, 34 extend toward the rear face 26. In typical embodiments, the entire length of each side face 32, 34 converges starting from adjacent the front face 24, with the side faces 32, 34 being generally planar between the front and rear faces 24, 26. In other embodiments, it is possible that the side faces 32, 34 start converging from a location spaced from the front face 24, in which case, the side faces 32, 34 would include a combination of straight, non-converging sections extending from the front face 24 and converging sections leading from the straight sections to the rear face 26. The converging portion of each side face 32, 34 typically converges at an angle 46 of 12-16 degrees, for example, about 14.5 degrees. Alternatively, the block 20 can be provided with only one converging side face or side face portion, with the other side face being substantially perpendicular to the front and rear faces 24, 26. A block with at least one converging side face permits serpentine retaining wall to be constructed.

In the embodiment shown, the block 20 includes a lip or flange 48. The lip 48 extends below the lower face 30 of the block 20 as can be seen in FIGS. 1-4. The lip 48 is designed to engage or abut against the rear face 26 of a like block 20 in the course below the block 20 to provide a pre-determined set-back from the course below and provide course-to-course shear strength.

Figure 4:
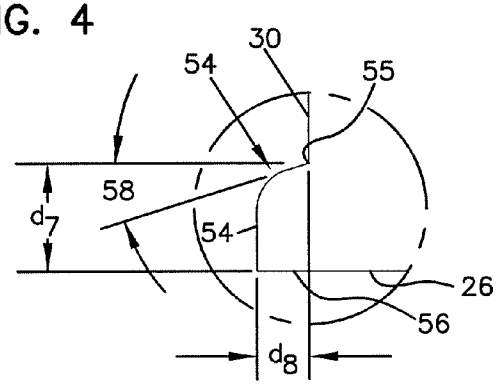
FIG. 4 is a detailed view of a portion of the retaining wall block contained within the dashed circle in FIG. 3.

In FIG. 4, the flange or lip 48 includes a front surface 50 that engages the rear face 26 of the block or blocks 20 in the course below. The flange or lip 48 also includes a bottom surface 52, a front bottom edge 54 between the front surface 50 and the bottom surface 52 that is arcuate, and a rear surface 56 that is an extension of and forms a portion of the rear face 26 of the block 20. A radiused surface 55 is defined between the lower face 30 and the front surface 50. The radiused surface 55 has a radius of typically under 0.1 in., for example, 0.015-0.05 in., such as 1/32 of an inch.

The front surface 50 is preferably angled at an angle 58 of between 15-20 degrees, typically about 18 degrees. The angled front surface 50, bottom edge 54, and radiused surface 55 result from corresponding shaped portions of the mold, which construction facilitates filling of the mold with dry cast concrete and release of the flange or lip 48 from the mold. This is explained further below.

As can be seen in FIGS. 1 and 2, the lip or flange 48 extends the entire distance between the side faces 32, 34. In other embodiments, the lip or flange 48 need not extend the entire distance. For example, the lip or flange 48 could extend only a portion of the distance between the side faces 32, 34 and could be spaced from the side faces 32, 34. Alternatively, two or more portions of a lip or flange 48 could be used separated from each other by a gap.

In the embodiment depicted in FIG. 4, the depth d7 of the flange 48 is between 0.5-1.0 inches, typically about 0.750 inches. This depth defines the resulting set-back of the block 20 relative to the course below. Other flange dimensions could be used, depending upon the amount of desired set-back. The rear surface 56 has a height d8 of 0.25-0.5 inches, typically about 0.375 inches.

B. Example Structures Made from Blocks, FIGS. 5 and 6

Blocks 20, as described above, may be used to build any number of landscape structures. An example of a structure that may be constructed with blocks 20 is illustrated in FIG. 5 as retaining wall 36. Retaining wall 36 includes a plurality of individual courses 60, 61, 62. The blocks 20 used in constructing the wall 36 may include blocks 20 having identically patterned front faces 24 or a mixture of blocks with different, but compatibly patterned faces. In other embodiments, the front faces 24 may be plain and unornamented. The height of the wall 36 will depend upon the number of courses that are used. The construction of retaining walls is known in the art. A description of a suitable process for constructing the wall 36 is disclosed in U.S. Pat. No. 5,827,015.

As described above, the lip or flange 48 on the block 20 provides set-back of the block from the course below. As a result, the course 61 is set-back from the course 62, and the course 60 is set-back from the course 61. The rearward incline of the front face 24 reduces the ledge that is formed between each adjacent course, by reducing the amount of upper face portion of each block 20 in the lower course that is visible between the front face 24 of each block 20 in the lower course and the front face 24 of each block 20 in the adjacent upper course.

The retaining wall 36 depicted in FIG. 5 is straight. In other embodiments, the block 20 can be used to make serpentine or curved retaining walls due to the angled side faces 32, 34. Such serpentine or curved retaining walls are described in U.S. Pat. No. 5,827,015.

Figure 6:
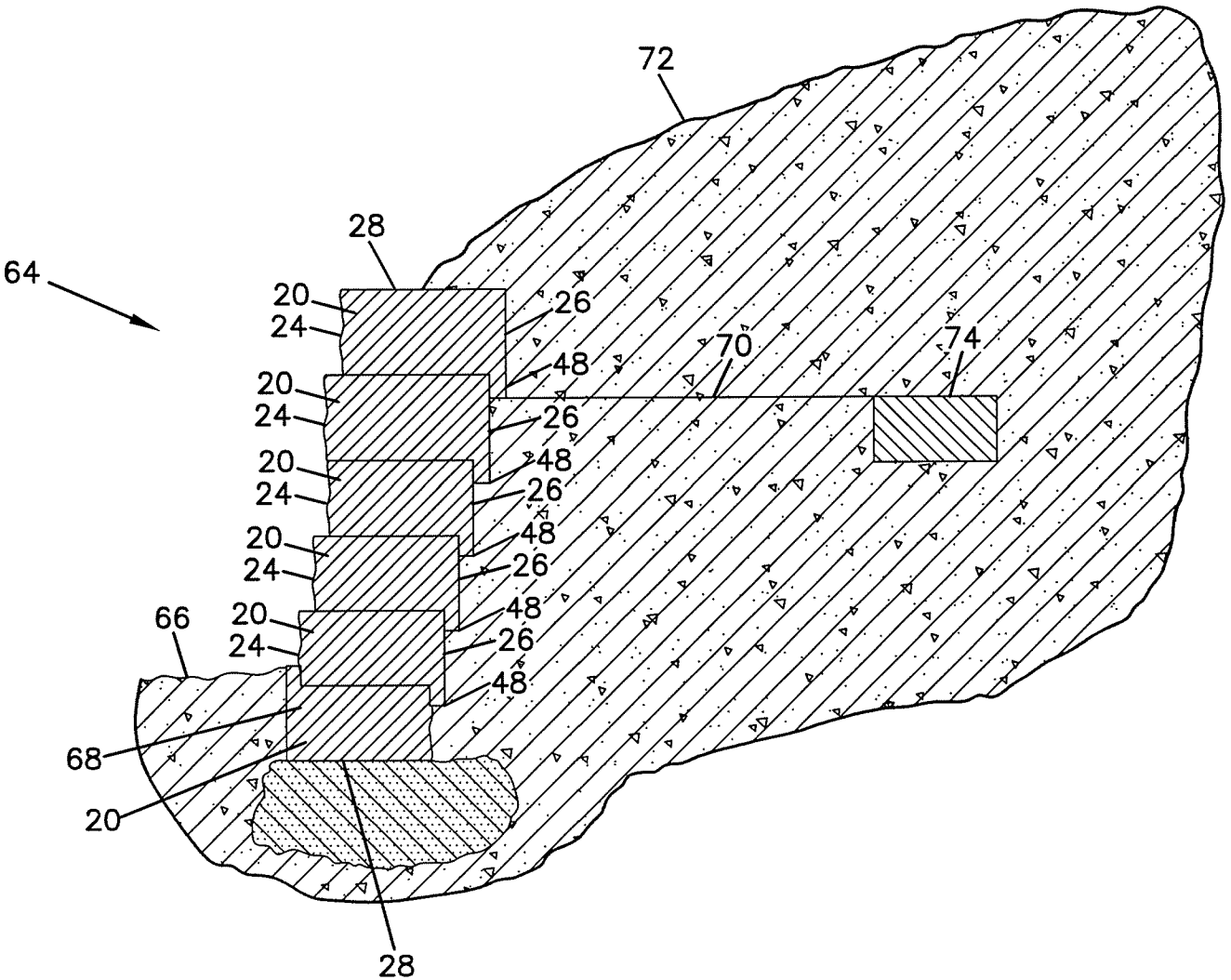
FIG. 6 is a schematic, cross-sectional view showing blocks made according to this disclosure in a retaining wall.

FIG. 6 depicts another embodiment of a retaining wall 64, which may be constructed from blocks 20. In FIG. 6, the wall 64 is constructed by forming a trench in the earth 66. The first course 68 is seated in the trench and will be under the soil once the wall 64 is back filled. The blocks 20 are placed on a securing mat or matrix 70, which is secured within the bank 72 by deadheads 74. The deadheads 74 serve as an additional stabilizing factor for the wall 64 providing additional strength. The deadheads 74 may be staggered at given intervals over the length of each course and from course-to-course to provide an overall stability to the entire wall structure 64.

The first course 68 may often include blocks 20 that are laid on their upper face 28 to define a pattern or stop at the base of the wall 64. As can be seen in FIG. 6, successive courses of blocks 20 are then stacked on top of preceding courses, while back filling the wall with soil 72. As can be also be seen in FIG. 6, the lip or flange 48 of each block 20 engages the rear face 26 of the block or blocks 20 in the course below. This provides set-back to the wall 64.

C. The Mold Assembly, FIGS. 7-19

Figure 7:
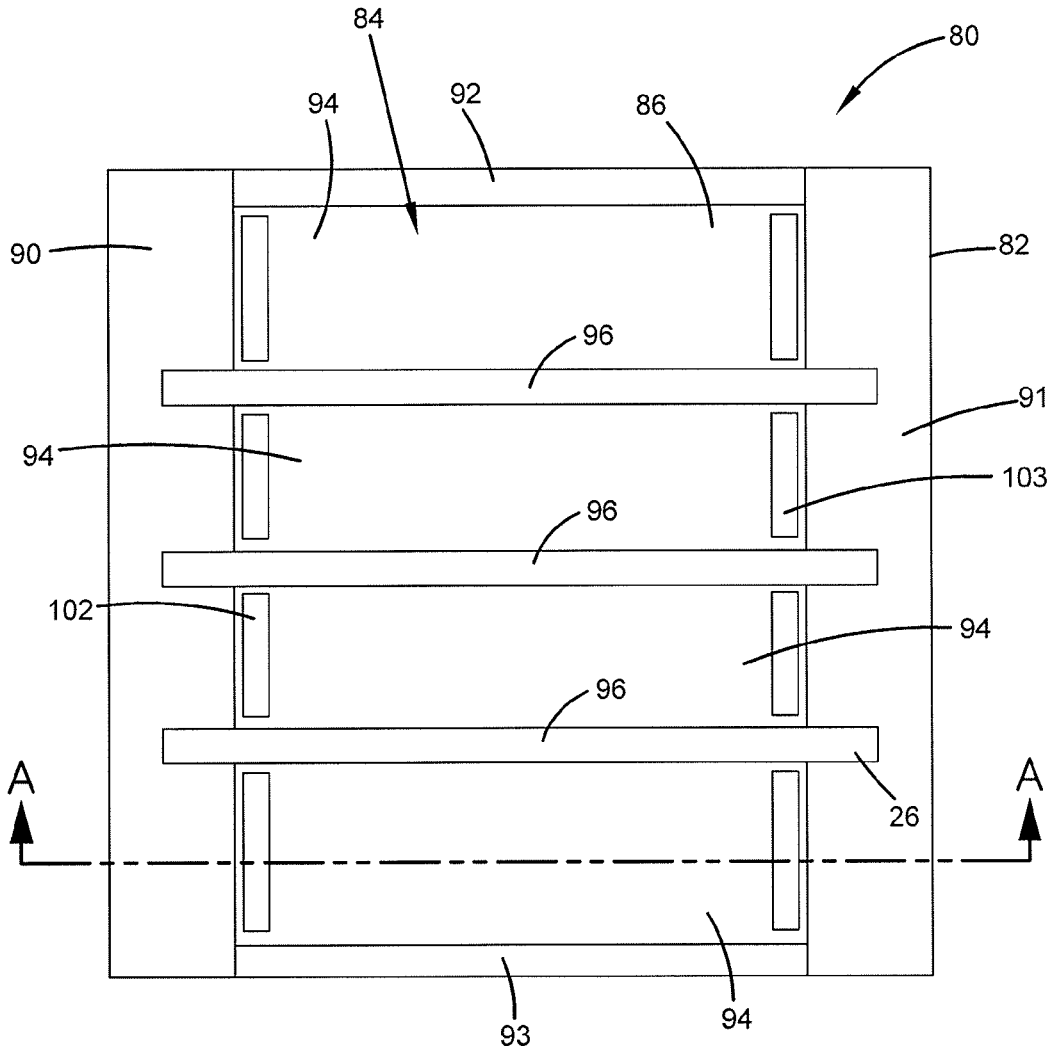
FIG. 7 is a top plan view of a concrete block mold, constructed in accordance with principles of this disclosure.

In FIG. 7, one embodiment of a concrete retaining wall block mold is illustrated at 80. In the embodiment of FIG. 7, the mold 80 is depicted as a generally rectangular structure 82, but can be other shapes, defining a mold cavity 84, where both the top 86 and bottom 88 (FIG. 15) are open. The structure 82 in the embodiment shown is generally defined by two mold sidewalls 90, 91 and two mold end walls 92, 93, also referred to herein as "outside division plates 92, 93." The mold cavity 84 may be further divided into a plurality of individual block-forming cavities 94 by a plurality of division plates 96, also referred to herein as "inside division plates 96." Herein, the use of the term "division plate" can refer to either the outside division plates 92, 93 or the inside division plates 96. The embodiment of FIGS. 14 and 15 further depict cross-division plates 98 to further divide the block-forming cavities 94 into further subcavities 100 to form blocks 20 that are half-sized. The cross-division plates 98 are not depicted in the embodiment of FIG. 7.

In the embodiment of FIG. 7, the mold 80 further includes sidewalls 102, 103 are moveable in order to form the angled side faces 32, 34 of the block 20. The inside division plates 96 and the sidewalls 102, 103 together define the individual block-forming cavities 94. The cavities 94 at each respective end of the mold 80 are defined by one of the outside division plates 92, 93 and the sidewalls 102, 103.

During block formation, the open bottom 88 of the mold 80 and each block-forming cavity 94 is closed by pallet 35 (FIG. 18) that is moved into place under the mold 80. The top 86 of the mold 80 is open to allow dry cast concrete to be deposited into the cavities 94, after which stripper shoes connected to a compression head are brought into contact with the concrete within the cavities 94.

In this embodiment, the mold 80 is constructed so that the blocks 20 are formed so that the block front face 24 is facing upwardly, and the block rear face 26 is supported on the pallet 35 (FIG. 18) positioned underneath the mold 80. Further information on this type of block forming process can be found in U.S. Pat. No. 7,208,112. In this orientation, the upper face 28 and lower face 30 of the block 20 are formed by two adjacent inside division plates 96, or by an inside division plate 96 and one of the outside division plates 92, 93.

Figure 8:
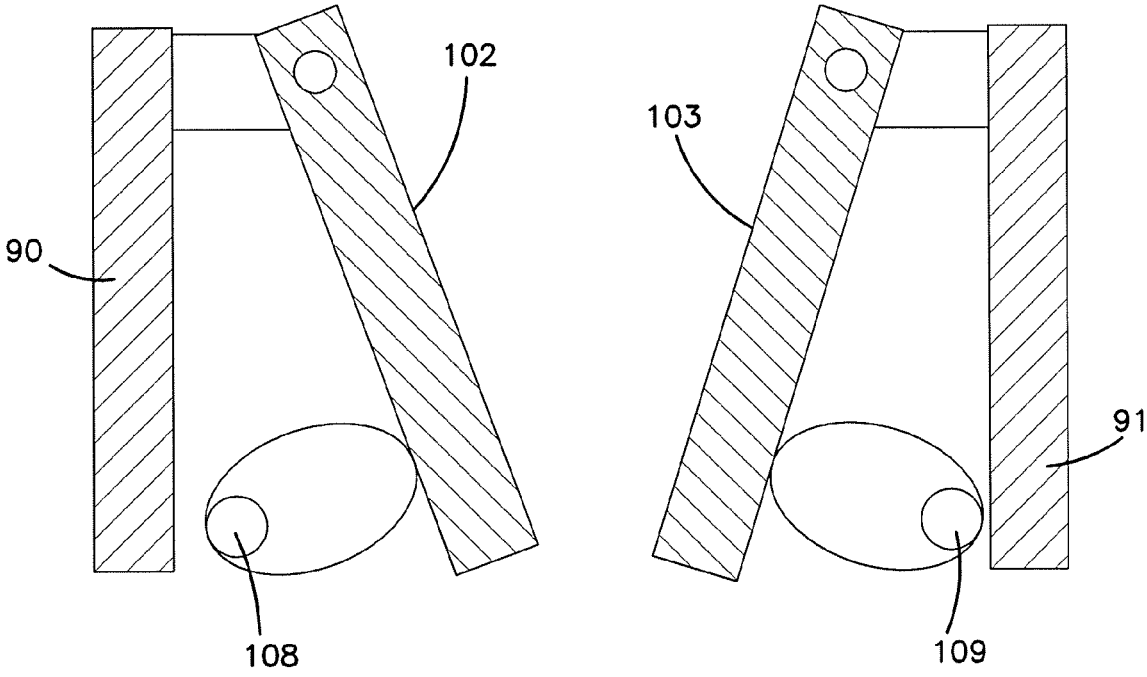
FIG. 8 is a cross-sectional view of the concrete block mold taken along the line A-A of FIG. 7.

FIG. 8 depicts a schematic, cross-sectional view of the mold 80 taken at line A-A of FIG. 7. In FIG. 8, the side faces 32, 34, when they are angled, are formed by moveable sidewalls 102, 103. The moveable sidewalls 102, 103 move from a first position (a molding position) to a second position (a de-molding position). The first position is during the molding stage and is depicted in FIG. 8. In the molding stage, the sidewalls 102, 103 form the converging side faces 32, 34 of the block 20. When the sidewalls 102, 103 move, such as by pivoting with camshafts 108, 109, the walls 102, 103 are pivoted to a second position to allow for discharging of the molded block 20. That is, the walls 102, 103 are pivoted by the camshafts 108, 109 to be vertically parallel to the mold sidewalls 90, 91, which allows the molded block 20 to then be de-molded or discharged through the bottom 88 of the mold 80. The stripper shoes attached to the compression head or head assembly help to push the molded blocks 20 out of the cavities 94.

Often times, the block-forming surfaces of the mold cavities 94 are provided with replaceable wear liners that contact the concrete in the mold cavities 94. These liners help prevent wear on the inside division plates 96, block cavity moveable side walls 102, 103, and outside division plates 92, 93, which can be expensive to replace. The use of wear liners is known to those having ordinary skill in the art. Therefore, although not illustrated in the drawings, references to the moveable sidewalls 102, 103; mold end walls 92, 93 or outside division plates 92, 93; and inside division plates 96 as forming faces of the blocks 20 is meant to include direct formation of the faces by these parts as well as formation of the faces by wear liners attached to these parts.

Figure 9:
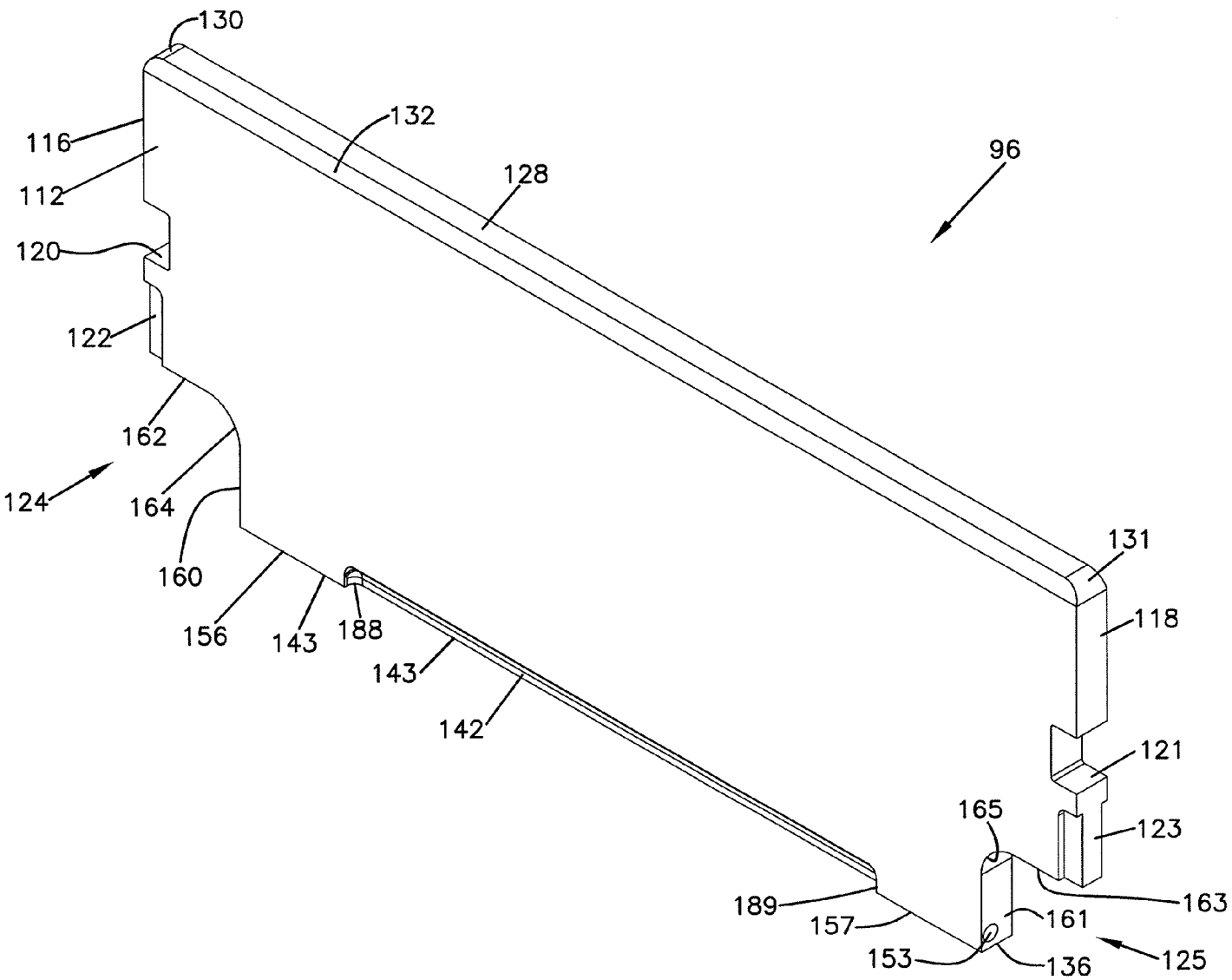
FIG. 9 is a perspective view of an inside division plate, constructed in accordance with principles of this disclosure.
Figure 12:
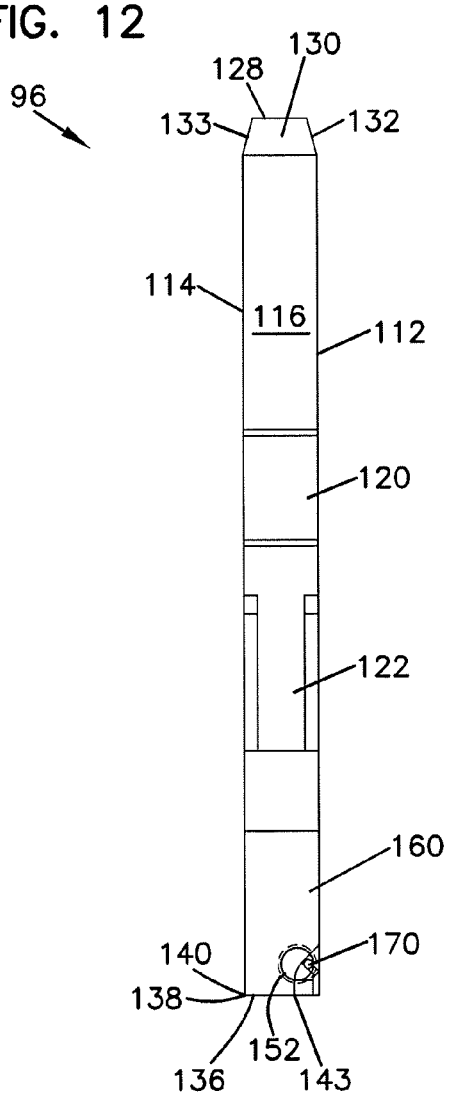
FIG. 12 is a side elevational view of the division plate of FIG. 10.

FIG. 9 illustrates a perspective view of one embodiment of an inside division plate 96 utilized in the mold 80. In the embodiment shown, the inside division plate 96 includes first and second opposite planar sides 112, 114 (FIG. 12). In the embodiment shown, the first planar face 112 is for forming the portion of the block 20 that will be the lower face 30 of the block in use. The second planar side 114 will form the portion of the block 20 that will be the upper face 28 of the block in use. The thickness of the plate 96 is defined between the first planar side 112 and second planar side 114. Suitable thicknesses include 0.5-3.0 inch, for example 0.7-0.8 inch.

The inside division plate 96 shown in FIGS. 9-13 further includes first and second side edges 116, 118. In the embodiment shown, the first and second side edges 116, 118 are constructed and arranged for being received by and held within the mold 80, specifically the sidewalls 90, 91. In some embodiments, the first and second side edges 116, 118 are held within channels or grooves within the mold sidewalls 90, 91. The first and second side edges 116, 118, in this embodiment, are mirror-images of each other. Each of the first and second side edges 116, 118, in this embodiment, defines a recess 120, 121, which is depicted as having an open rectangular-shaped cross-section. The recesses 120, 121 are for engaging other structure within the mold 80 to help secure the division plate 96 within the mold 80.

Located adjacent to and below the recesses 120, 121 are T-bars 122, 123, also provided for engaging mating structure within the mold 80 to help secure the inside division plate 96 therewithin.

Adjacent to and below the T-bars 122, 123 are cutouts 124, 125. The cutouts 124, 125 accommodate the camshafts 108, 109 (FIG. 8) within the mold 80 to allow for rotation of the camshafts 108, 109 in order to move the sidewalls 102, 103 from their molding position (such as shown in FIG. 8) to their de-molding position, in which the block 20 is being stripped from the mold 80. In the embodiment shown, each cutout 124, 125 has a vertical portion 160, 161 and a horizontal portion 162, 163, with each respective vertical 160, 161 and horizontal portion 162, 163 being joined by a curved portion 164, 165.

Still in reference to FIGS. 9-13, the inside division plate 96 depicted, includes a top side 128. In this embodiment, the top side 128 extends the length between the first side edge 116 and side edge 118. The top side 128 depicted defines first and second radiused corners 130, 131, and also first and second radiused sides 132, 133 (FIG. 12). The radiused sides 132, 133 join the top side 128 to the respective first planar side 112 and second planar side 114. The radiused corners 130, 131 join the top side 128 to the respective first side edge 116 and second side edge 118. A suitable length for the top side 128 is 15-48 inches, for example 20-25 inches.

Figure 13:
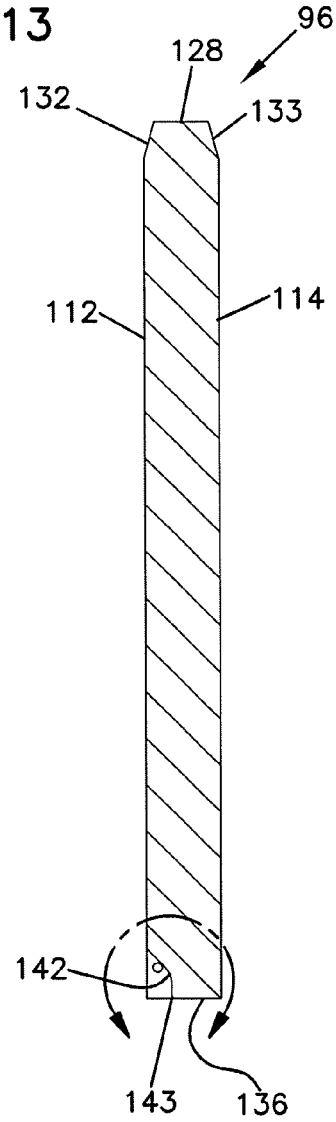
FIG. 13 is a cross-sectional view of the division plate of FIG. 10, the cross-section being taken along the line 13-13 of FIG. 10.
Figure 13A:
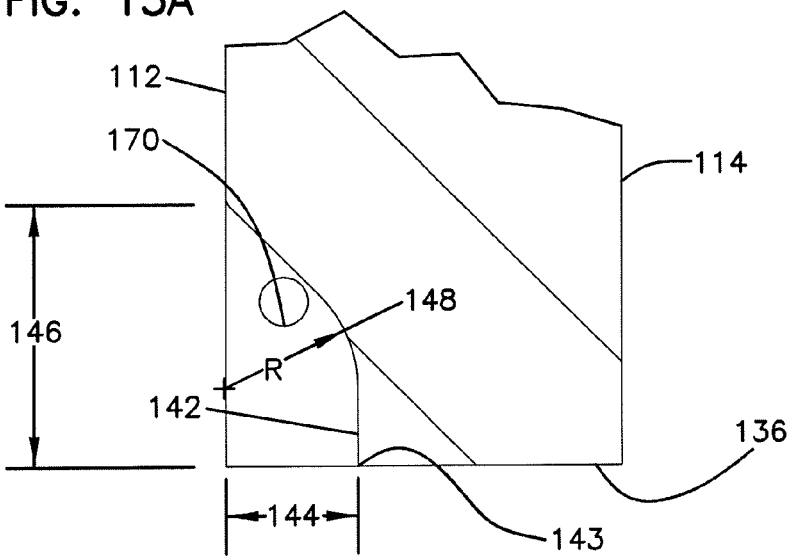
FIG. 13*a* is an enlarged view of the portion in dotted lines of FIG. 13.
Figure 14:
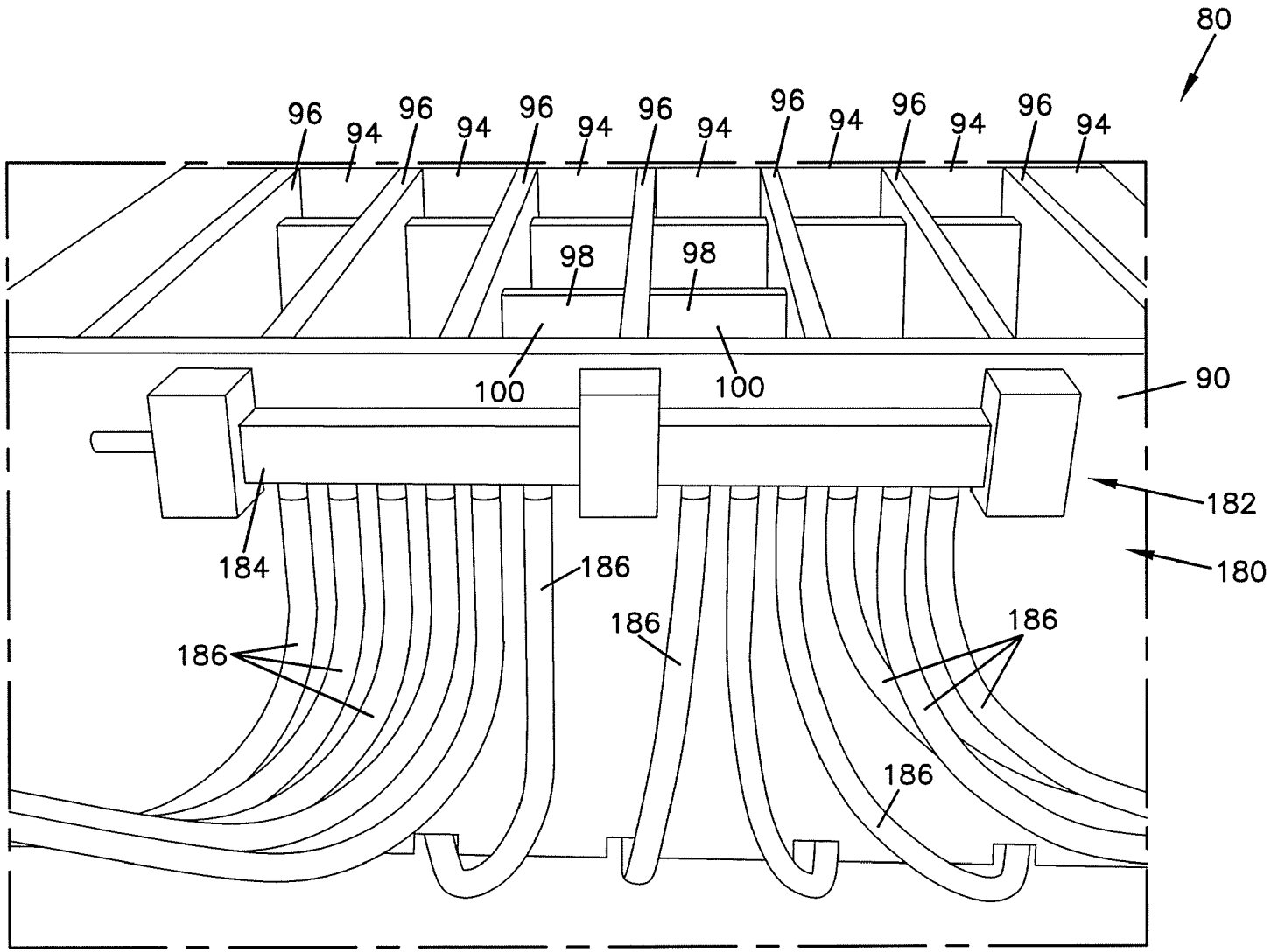
FIG. 14 is a schematic, perspective view of a portion of a concrete block mold, constructed in accordance with principles of this disclosure.
Figure 15:
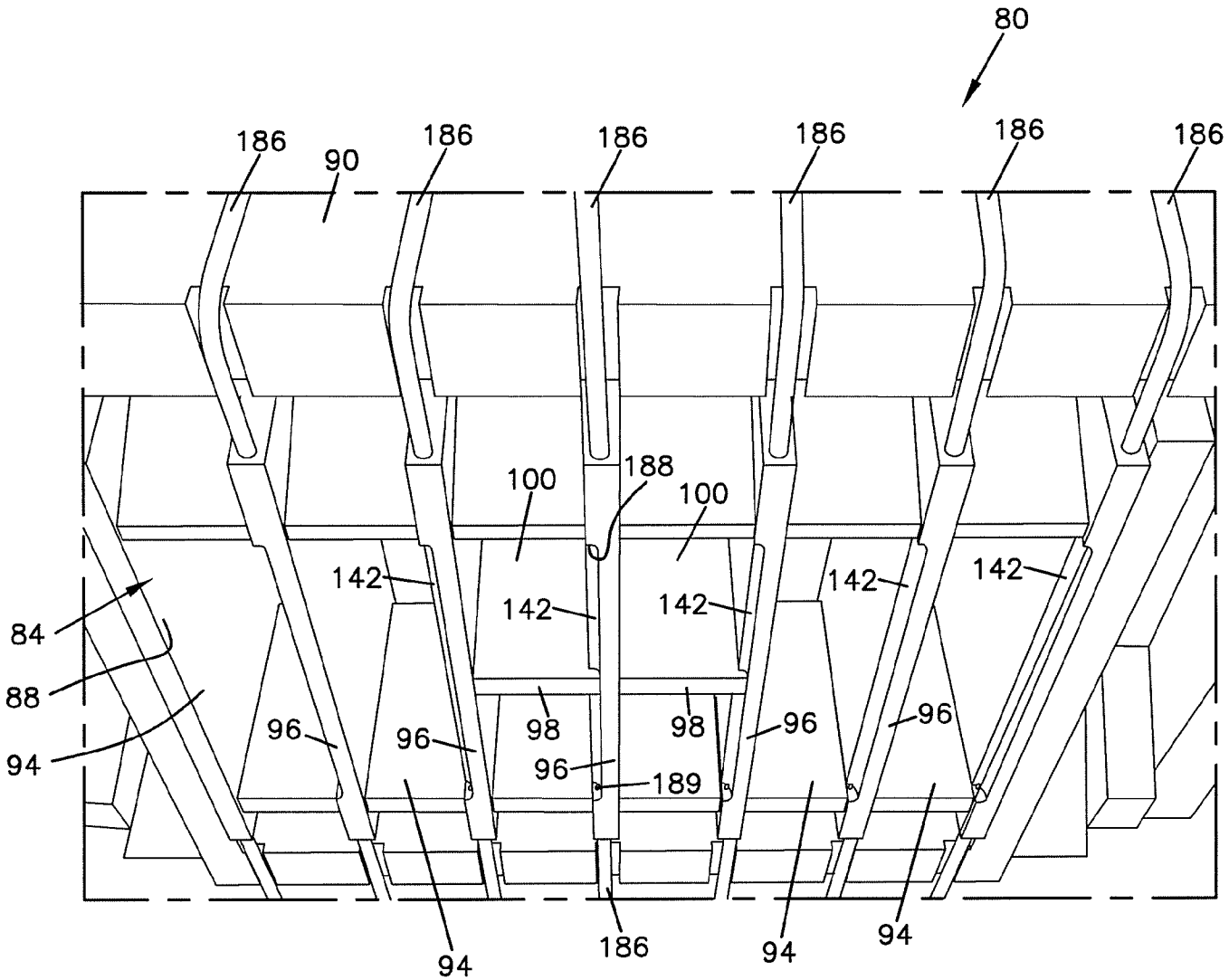
FIG. 15 is another schematic, perspective view of the concrete mold of FIG. 14, this view being a bottom perspective.
Figure 16:
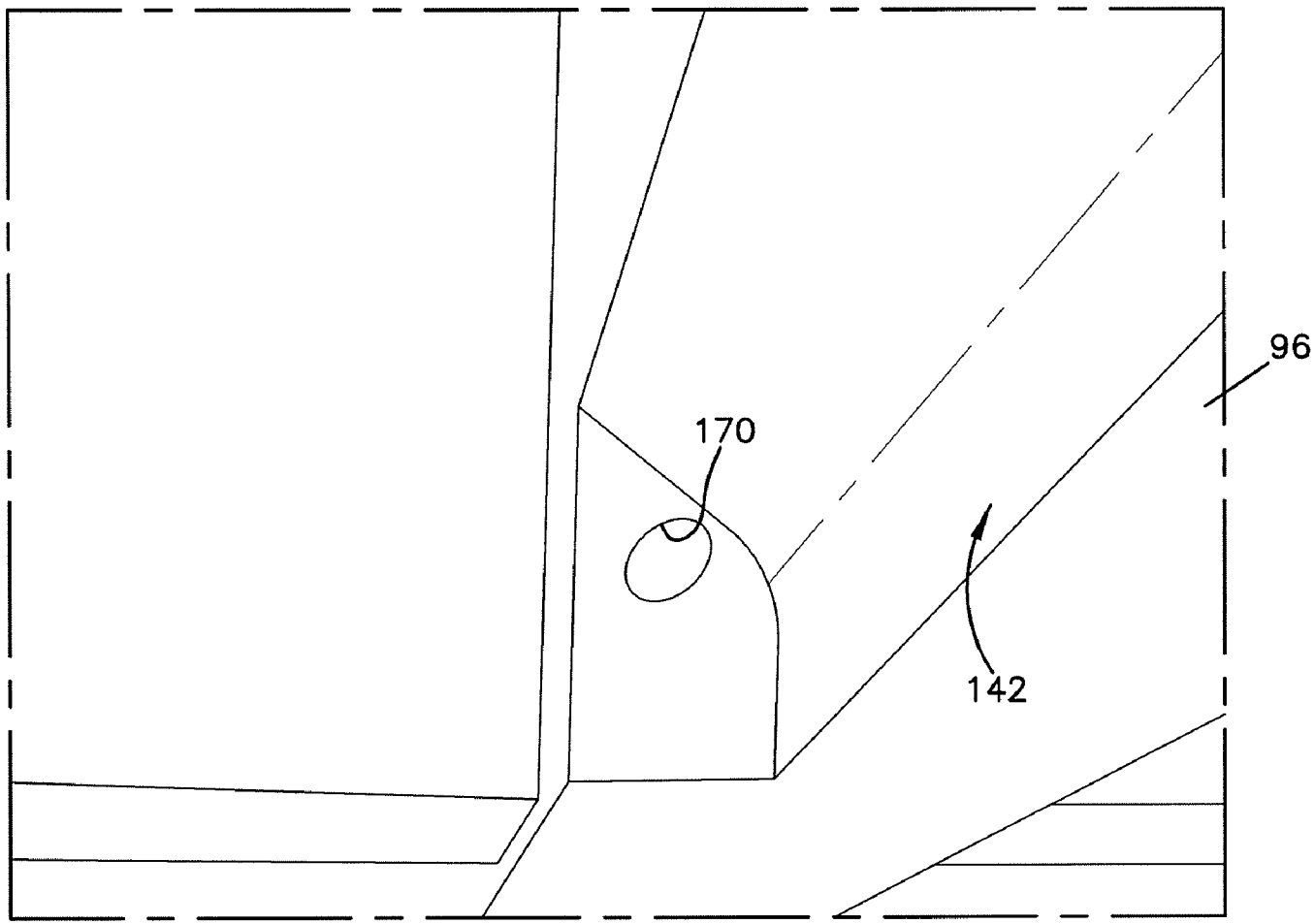
FIG. 16 is a schematic, perspective view of a portion of the concrete block mold of FIGS. 14 and 15.

The inside division plate 96 depicted in FIGS. 9-13 further includes a bottom side 136. The bottom side 136 is opposite and parallel to the top side 128. In this embodiment, the bottom side 136 extends the length between the vertical portions 160, 161 of the cutouts 124, 125 of the first and second side edges 116, 118. In FIGS. 12 and 13, it can be seen how an intersection 138 between the second planar side 114 and bottom side 136 is generally perpendicular, forming a corner 140.

The inside division plate 96, in the embodiment shown, further includes an undercut 142 or instep 142. In the embodiment shown, the undercut 142 is defined by a recess along a bottom edge 143, which is at the intersection of the first planar side 112 and bottom side 136. The undercut 142, in this embodiment, extends only partially between the cutouts 124, 125 of the first and second side edges 116, 118 and is spaced from vertical portions 160, 161 by first and second bottom edge sections 156, 157. In other embodiments, the undercut 142 may extend an entire length between the first and second side edges 116, 118. When the mold 80 is oriented upright in normal usage on flat pallet 35 (FIG. 18) during the molding process so that the open bottom 88 of the mold 80 is closed by the pallet 35, the lip-forming undercut 142 and the pallet 35 together define a lip-forming subcavity 154 (FIG. 18) into which the dry cast concrete is compacted to result in forming the flange or lip 48 on the block 20.

The undercut 142 has a geometry to result in a desirable and usable lip 48. While a variety of implementations are useful, in the embodiment shown, the undercut 142 has a width 144 of 0.1-0.3 inch, for example, about 0.25; a height 146 of 0.4-0.6 inch, for example, about 0.51 inch; a radius 148 of 0.2-0.3 inch, for example, about 0.25 inch; and a length 150 (FIG. 10) of 10-15 inches, for example about 13 inches.

In accordance with principles of this disclosure, the undercut 142 will be cleanable through an automatic, non-manual system. In one embodiment, the undercut 142 is cleanable by emitting fluid at the undercut 142 by way of access with at least a single hole or bore 152 through the division plate 96. In the example shown in FIGS. 9-13, there are a pair of holes or bores 152, 153, but it should be understood that in some embodiments, only a single hole or bore 152 is used.

In FIGS. 9-13, each of the bores 152, 153 provides a conduit for fluid communication between the undercut 142 and a region outside of the inside division plate 96. In the embodiment shown, each of the bores 152, 153 forms a through-hole from the respective vertical edge portion 160, 161 into the first and second bottom edge sections 156, 157 of the division plate 96, and extending through to the undercut 142. In general, the bores 152, 153 are for accommodating a fluid, such that the fluid can be sent to the undercut 142 to remove dry cast concrete from the undercut 142 after molding one block 20 and before molding the next block 20. This allows the undercut 142 to be cleaned of debris and any concrete mixture that sticks to the subcavity 142. Keeping the subcavity 142 clean will allow the radius 55 of the block 20 to remain within a controlled tolerance. As used herein, the term "fluid" generically includes gas, liquid, and gas/liquid mixtures such as mists, dispersions, and colloids.

Figure 17:
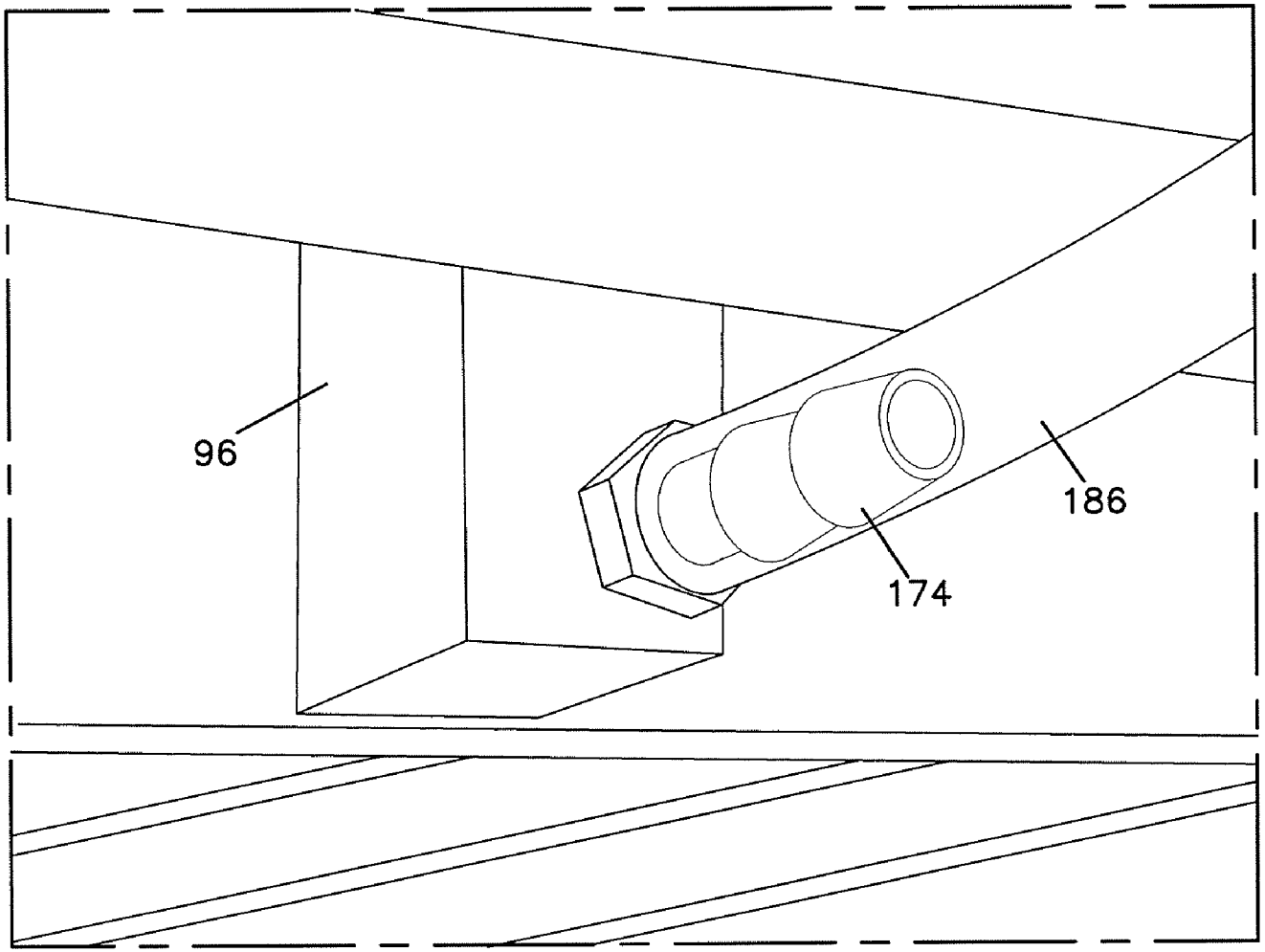
FIG. 17 is another schematic, perspective view of a portion of the concrete block mold of FIGS. 14-16.

The bores 152, 153 are constructed and arranged to permit fluid, such as compressed gas, preferably compressed air, to be passed threrethrough in order to reach the undercut 142. In the embodiment depicted in FIG. 10, each of the bores 152, 153 nozzle receptacle portion 168, 169, and a fluid delivery conduit portion 170, 171. In the embodiment depicted, the nozzle receptacle portions 168, 169 receive a nozzle 174 as depicted in FIG. 17. The nozzle 174 will deliver compressed air, to the respective fluid-delivery conduit portion 170, 171, which will then exit the respective bore 152, 153 and travel across the undercut 142.

The bores 152, 153 have a size suitable to convey the compressed air to the subcavity 142. For example, the bores 152, 153 can have a length of 2-3 inches, for example about 2.4-2.6 inches. The nozzle receptacle portions 168, 169 will have a diameter of about 0.5 inch (or, for example, ⅛ inch NPT), while the conduits 170, 171 will have a diameter of about 0.092 inch. The bores 152, 153 are spaced from the bottom side 136 a distance of, for example, 0.2-0.5 inch, for example, 0.30-0.35 inch.

Figure 10:
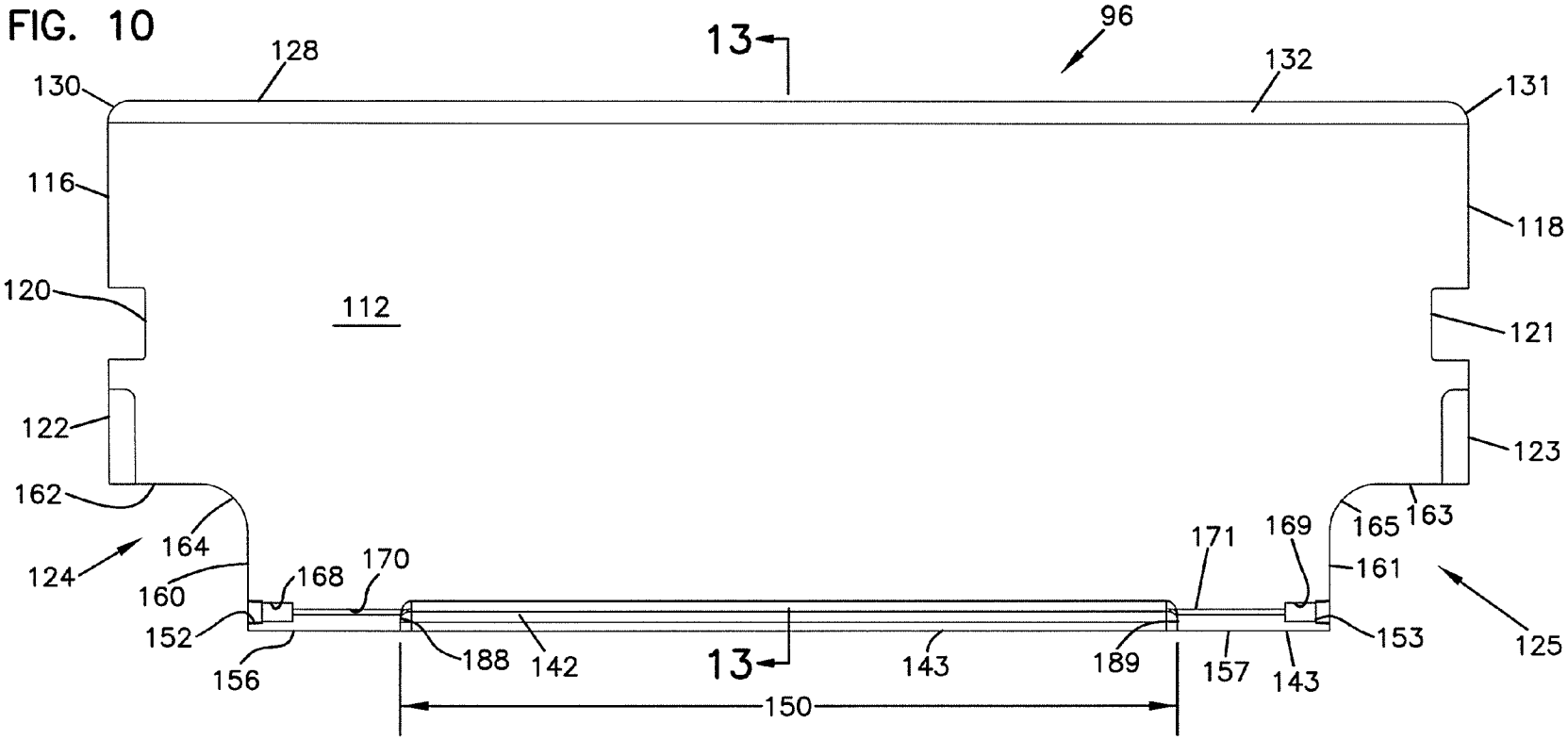
FIG. 10 is a front elevational view of the division plate of FIG. 9.
Figure 11:
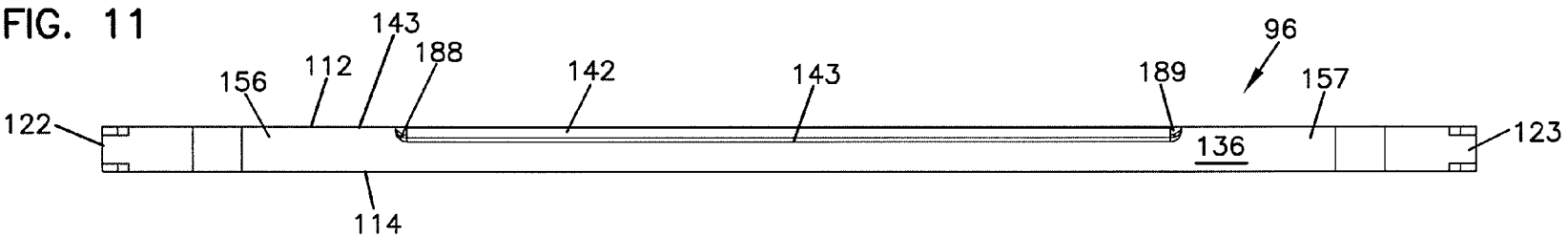
FIG. 11 is a bottom, end view of the division plate of FIG. 10.

As can be seen in the particular embodiment illustrated in FIG. 10, the fluid-delivery conduit portions 170, 171 are in opposition to each other in that they face each other with the undercut 142 extending therebetween. The bores 152, 153, along with the fluid forms part of a cleaning system 180 (FIG. 14), described below.

Figure 19:
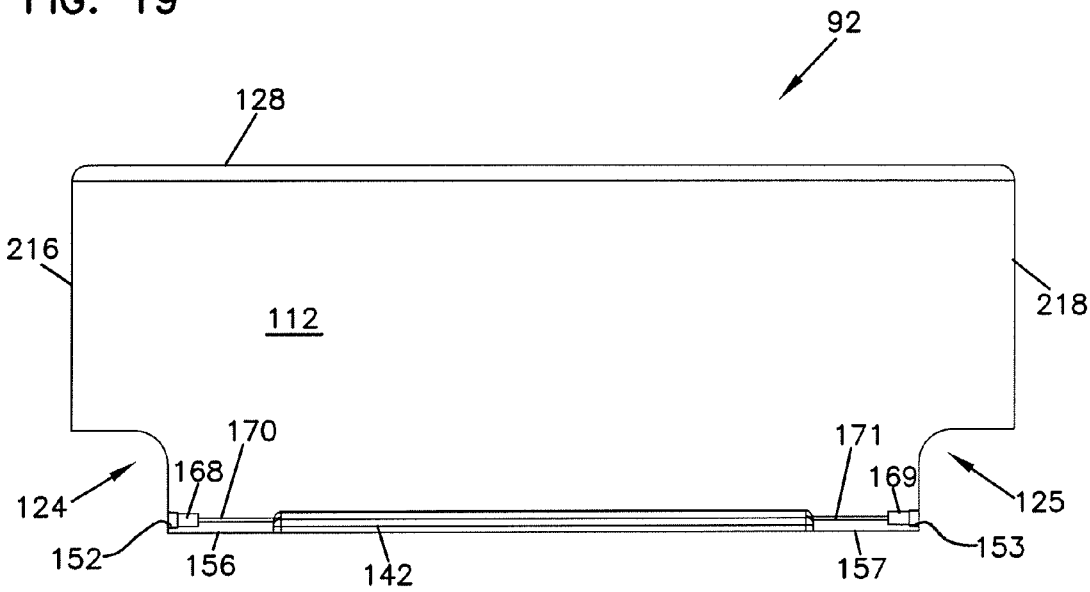
FIG. 19 is a front elevational view of an outside division plate, constructed in accordance with principles of this disclosure.

FIG. 19 illustrates an embodiment of one of the outside division plates 92. In the mold configurations of FIG. 7, there is a pair of outside division plates, shown in FIG. 7 at 92 and 93. In many preferred mold configurations, one of the outside division plates 92 will have lip-forming undercut 142, while the other of the outside division plates 93 will be flat and planar on each side. The outside division plate 92 in FIG. 19 is shown with the lip-forming undercut 142, which has the same dimensions and geometry as undercut 142 of the inside division plates 96. The outside division plate 92 is preferably identical to the inside division plate 96, and thus carries the same reference numerals for the same structural features, with the exception of features that relate to securing the outside division plate 92 to the remaining portions of the mold. Each of the outside division plates 92, 93 are bolted to the mold 80 through the back of the plate, and therefore do not need recesses, such as recesses 120, 121 (division plate 96 in FIG. 10) along side edges 116, 118 (division plate 96 in FIG. 10) to allow attachment to the mold 80. Rather, the outside division plate 92 has first and second side edges 216, 218 that are straight from top side 128 to cutouts 124, 125. The outside division plate 92 has otherwise the same structural features as inside division plate 96 including: undercut 142 which forms subcavity 154 with the pallet 35; holes or bores 152, 153 (which, in some embodiments, can be just a single bore 152); first and second bottom edge sections 156, 157; nozzle receptacle portions 168, 169; and fluid delivery conduit portions 170, 171.

The cleaning system 180 is provided to non-manually remove dry cast concrete from the undercut 142. A variety of implementations may be used. In the particular embodiment shown, the cleaning system 180 includes a fluid injection system 182, which is used to deliver fluid to the undercut 142. Various fluids can be used, including fluids in the form of liquid, fluids in the form of gas, and mixtures of liquid and gas. The liquid may include a lubricant, such as oil. Oil may be atomized as a mist with the compressed air to be delivered to the undercut 142.

In the embodiment depicted, compressed air is delivered from a manifold 184. Connected to the manifold 184 is a plurality of hoses 186, with each hose 186 being connected to one of the bores 152, 153 of each division plate having undercut 142, which can include all of the inside division plates 96 and one of the outside division plates 92. In the embodiment depicted in FIG. 17, each hose 186 is secured to a nozzle 174, which is connected to one of the bores 152, 153. In this manner, compressed air is emitted, or injected, pulsed, or jetted through each bore 152, 153, from the manifold 186, to the hose 186, through the nozzle 174, through the respective fluid-delivery conduit portion 170, and finally to the undercut 142. As the compressed air is emitted from opposite ends 188, 189 (FIG. 10) of each undercut 142, it traverses the length 150 of the subcavity 142 and forcibly removes dry cast concrete or other debris that may be sticking or otherwise clinging to the surface of the undercut 142. In some embodiments, the air is emitted only from one end 188 of the undercut 142, to send the air across the undercut 142 and remove dry cast concrete or other debris from the undercut 142.

As mentioned above, the cleaning system 180 is operated non-manually. Typically, the cleaning system 180 is operated automatically as part of the overall molding process. For example, in a process for manufacturing concrete retaining wall blocks 20, dry cast concrete mixture is deposited into the top 86 of the mold 80. The mold 80 will be positioned upright with its two parallel mold sidewalls 90, 91 and two parallel mold outside division plates (or end walls) 92, 93 perpendicular to the mold side walls 90, 91. The upright mold 80 is positioned on pallet 35 (FIG. 18) so that the open bottom 88 is closed by the pallet 35. The concrete retaining wall block 80 is formed by compacting the dry cast concrete mixture against surfaces within the block-forming cavities 94, including forming the flange or lip 48 by compacting the dry cast concrete against surfaces in the undercut 142 and the pallet 35 in the lip-forming subcavity 154. The block 20 is then stripped from the mold and oriented onto the pallet 35, typically by contacting the open top 86 of the mold with a stripper shoe. The stripper shoe can be three-dimensional forming a pattern having a relief of at least 0.5 inch. After the step of stripping, the step of non-manually cleaning the undercut 142 is performed.

The step of non-manually cleaning the undercut 142 can include emitting a jet of compressed air at the undercut 142. This step can be done automatically by sensing when the block 20 has stripped from the mold 80.

For example, one way of accomplishing this step of sensing is by sensing the position of the mold 80. For example, the sensors can sense when the uncured block 20 has left the mold. Based on this, the step of non-manually, or automatically, cleaning includes sensing the position of the mold 80 and based on the position, emitting a jet of compressed air at the undercut 142.

In one embodiment, when the moveable sidewalls 102, 103 move from the molding position to the second, de-molding position, a hydraulic control unit sends a signal to an air control unit indicating the status. Timers then begin and open an air solenoid valve after a set amount of time. This time delay gives the block 20 enough time to be ejected from the mold 80. Timers also begin and close the solenoid valve after a set amount of time. This gives adequate time to clean the undercut(s) 142. For example, after the moveable sidewalls 102, 103 move to the de-molding position, and the uncured block 20 leaves the mold 80, the timers will be set to open the air solenoid after a set time.

The above represents examples and principles. Many embodiments can be made and methods practiced in accordance with these principles.

What is claimed is:

1. A mold for forming dry cast concrete retaining wall blocks front molded face up; the retaining wall blocks, with respect to orientation in a retaining wall, having the front molded face with a predetermined three-dimensional pattern, an opposite rear face, top and bottom opposite faces extending between the front and rear faces, and side faces extending between the front and rear faces and the top and bottom faces; the bottom face having a lip projecting therefrom; the mold comprising:

a pair of opposed mold side walls;

at least a pair of opposed division plates extending between the opposed mold side walls, the mold side walls and division plates defining a mold cavity having an open top and an open bottom;

at least one division plate having a first planar side, opposite top and bottom edges, an undercut along the bottom edge which with a pallet under the mold defines a lip-forming subcavity therebetween, a pair of opposite side edges extending between the top and bottom edges, and at least one bore extending generally horizontally from at least one of the side edges through the division plate to the undercut; and a cleaning system comprising a fluid injection system constructed and arranged to deliver pressurized fluid through the at least one bore in the at least one division plate to non-manually remove dry cast concrete from the undercut which forms part of the lip-forming subcavity.

2. The mold according to claim 1 wherein the pair of opposed division plates are end walls.

3. The mold according to claim 2 wherein the mold further includes:

at least one inside division plate extending between the opposed mold side walls and dividing the mold cavity into a plurality of block-forming cavities; the at least one inside division plate having a first planar side, opposite top and bottom edges, an undercut along the bottom edge which with a pallet under the mold defines a lip-forming subcavity therebetween, a pair of opposite side edges extending between the top and bottom edges and at least one bore extending generally horizontally from at least one of the side edges through the division plate to the undercut;

wherein the cleaning system is constructed and arranged to deliver pressurized fluid through the at least one bore in the at least one inside division plate to non-manually remove dry cast concrete from each undercut.

4. The mold of claim 3 wherein:

the at least one inside division plate includes a plurality of spaced inside division plates extending between the opposed mold side walls and dividing the mold cavity into a plurality of block-forming cavities; each of the inside division plates having a first planar side, opposite top and bottom edges, an undercut along the bottom edge which with a pallet under the mold defines a lip-forming subcavity therebetween, a pair of opposite side edges extending between the top and bottom edges and at least one bore extending generally horizontally from at least one of the side edges through the division plate to the undercut; and the cleaning system is constructed and arranged to emit a jet of compressed gas through the at least one bore in each of the inside division plates to non-manually remove dry cast concrete from each undercut.

5. The mold of claim 1 wherein the fluid injection system is constructed and arranged to emit compressed gas through the bore at the undercut which forms part of the lip-forming subcavity.

6. The mold of claim 1 wherein:

the at least one division plate defines first and second opposing bores located at opposite ends of the undercut;

each of the first and second bores extending through the division plate from the respective side edge of the division plate to the undercut;

each of the bores being a conduit for delivery of the fluid to the undercut.

7. The mold of claim 1 further including:

at least one movable side wall within a block-forming cavity that defines a block face shaping surface and that is actuated by a mechanism; and the at least pair of division plates has cut-outs to provide clearance with the movable side wall actuating mechanism.

8. The mold of claim 1 further comprising:

a control system to direct operation of the cleaning system; the control system constructed and arranged to monitor the position of the mold and to emit a jet of compressed gas through the bore at the undercut which forms part of the lip-forming subcavity, when the block has left the mold.

9. The mold of claim 1 wherein the lip-forming subcavity has a width of 0.1-0.3 in.; a height of 0.4-0.6 in.; a radius of 0.2-0.3 in.; and a length of 10-15 in.

10. The mold of claim 1 further comprising a stripper shoe oriented at the open top of the mold; the stripper shoe having a predetermined three-dimensional pattern with a relief of at least 0.5 inch.

* * * * *